US010389091B2

(12) United States Patent
Ishiguro

(10) Patent No.: US 10,389,091 B2
(45) Date of Patent: Aug. 20, 2019

(54) SPARK PLUG FOR INTERNAL COMBUSTION ENGINE AND IGNITION SYSTEM HAVING SPARK PLUG

(71) Applicant: DENSO CORPORATION, Kariya, Aichi-pref. (JP)

(72) Inventor: Hiroya Ishiguro, Kariya (JP)

(73) Assignee: DENSO CORPORATION, Kariya (JP)

( * ) Notice: Subject to any disclaimer, the term of this patent is extended or adjusted under 35 U.S.C. 154(b) by 245 days.

(21) Appl. No.: 13/910,354

(22) Filed: Jun. 5, 2013

(65) Prior Publication Data

US 2014/0020667 A1 Jan. 23, 2014

(30) Foreign Application Priority Data

Jul. 18, 2012 (JP) ..... 2012-159587

(51) Int. Cl.

| | |
|---|---|
| ***H01T 13/20*** | (2006.01) |
| ***H01T 13/44*** | (2006.01) |
| *F02P 3/02* | (2006.01) |
| *H01F 38/12* | (2006.01) |

(52) U.S. Cl.

CPC ..... *H01T 13/20* (2013.01); *H01T 13/44* (2013.01); *F02P 3/02* (2013.01); *H01F 38/12* (2013.01)

(58) Field of Classification Search

CPC ..... H01T 13/00; H01T 13/02; H01T 13/04; H01T 13/20; H01T 13/06

See application file for complete search history.

(56) References Cited

U.S. PATENT DOCUMENTS

| | | | | |
|---|---|---|---|---|
| 5,632,636 | A * | 5/1997 | Maekawa | 439/125 |
| 2003/0037745 | A1 * | 2/2003 | Moga et al. | 123/143 C |

FOREIGN PATENT DOCUMENTS

| | | |
|---|---|---|
| JP | H04-133282 | 5/1992 |
| JP | H08-284789 | 10/1996 |
| JP | H09-180856 | 7/1997 |
| JP | 2008-021870 | 1/2008 |

OTHER PUBLICATIONS

Japanese Patent Office, "Notification of Reasons for Rejection," (2 pages) issued in connection with Japanese Patent Application No. 2012-159587, dated Jul. 7, 2015, with its English language Translation (1 page).

* cited by examiner

*Primary Examiner* — Jacob M Amick
(74) *Attorney, Agent, or Firm* — Nixon & Vanderhye P.C.

(57) ABSTRACT

A spark plug for an internal combustion engine has a cylindrical insulator, a center electrode held inside of the insulator, and, a terminal portion held inside of the insulator and electrically connected to the center electrode. The insulator has a insertion portion arranged closer to the base end side than the housing is, the insertion portion being inserted into a cylindrical plug cap. The insertion portion has a non-fit portion formed at the base end of the insulator, and, a fit portion formed to the head end side of the non-fit portion, an outer diameter of the non-fit portion being equal to or smaller than an inner diameter of the plug cap, the fit portion being fitted in the inner periphery surface of the plug cap.

9 Claims, 8 Drawing Sheets

SPARK PLUG FOR INTERNAL COMBUSTION ENGINE AND IGNITION SYSTEM HAVING SPARK PLUG

CROSS-REFERENCE TO RELATED APPLICATION

This application is based on and claims the benefit of priority from earlier Japanese Patent Application No. 2012-159587 filed Jul. 18, 2012, the description of which is incorporated herein by reference.

BACKGROUND OF THE INVENTION

Technical Field of the Invention

The present invention relates to a spark plug used an internal combustion engine such as an engine on a vehicle, and, an ignition system having the spark plug.

Related Art

A spark plug is known as ignition means for igniting air-fuel mixture introduced in a combustion chamber of an internal combustion engine such as an engine on a vehicle. The spark plug has, for example, a cylindrical housing, an insulator held inside of the housing and projected further toward a base end side than the housing is, and, a center electrode held inside of the insulator and projected further toward a head end side than the insulator is (refer to a patent document JP-A-H09-180856). Furthermore, the spark plug has a ground electrode forming a spark discharge gap between the center electrode and itself, and, a terminal portion held inside of the insulator, electrically connected to the center electrode and projected further toward the base end side than the insulator. The spark plug makes a part of the insulator to be inserted and fitted in a plug cap.

In recent years, with heightening efficiency of the internal combustion engine, technologies such as high compression ratio, high boost pressure and lean burn are applied, and demanded voltage of the spark plug ("demanded voltage" is voltage which is applied between the center electrode and the ground electrode, and needed for discharges to occur) tends to increase. Then, if the voltage of the spark plug increases too much, electrical insulation performance in the plug cap cannot be ensured enough, which might cause electrical leak between the terminal portion and the housing.

As a method for solving such a problem, for example, a method where extending the insulator of the spark plug toward the base end side and lengthening the axial length of the insulator lengthens electrical insulation distance between the terminal portion and the housing has been conceived.

In the above-described method, lengthening the electrical insulation distance between the terminal portion and the housing of the spark plug can increase the electrical insulation performance in the plug cap. On the other hand, the axial length of the portion where the insulator and the plug cap fit together is extended by the length of the portion extended toward the base end side in the insulator 12. This increases insertion and separation forces in the plug cap, which decreases attachment workability of the spark plug.

SUMMARY

The present invention has been made in light of the background as set forth above and has as its object to provide a spark plug for an internal combustion engine, which can increase the electrical insulation performance in the plug cap, and, an ignition system having the spark plug.

A first exemplary embodiment provides a spark plug for an internal combustion engine which has a cylindrical insulator, a center electrode held inside of the insulator, and a terminal portion held inside of the insulator and electrically connected to the center electrode. The insulator has an insertion portion arranged closer to the base end side than the housing is, the insertion portion being inserted into a cylindrical plug cap. The insertion portion has a non-fit portion formed at the base end of the insulator, and a fit portion formed to the head end side of the non-fit portion, an outer diameter of the non-fit portion being equal to or smaller than an inner diameter of the plug cap, the fit portion being fitted in the inner periphery surface of the plug cap.

A second exemplary embodiment provides an ignition system for an internal combustion engine which has a spark plug according to the first exemplary embodiment, a coil portion as an ignition coil, and, a plug joint portion configured to electrically connect the coil portion to the terminal portion of the spark plug. The plug joint portion has a plug cap inside of which the insertion portion of the insulator of the spark plug is inserted.

DETAILED DESCRIPTION OF THE PREFERRED EMBODIMENTS

Throughout the specification and the claims, for the spark plug and the ignition system having the spark plug, the side on which the spark plug is inserted into a combustion chamber of an internal combustion engine is referred to as a "head end side", and the side opposite to the head end side in the axial direction of the spark plug is referred to as a "base end side". Therefore, throughout the specification and claims, a "base end" refers to the end on the base end side in the axial direction, and a "head end" refers to the end on the head end side in the axial direction.

Furthermore, throughout the specification and the claims, unless otherwise noted, for the spark plug, the terms "axial", "axially" or "axial direction", the terms "radial", "radially" or "radial direction" and the terms "circumferential", "circumferentially" or "circumferential direction" refer to "the axial direction of the spark plug", "the radial direction of the spark plug" and the "circumferential direction of the spark plug", respectively.

First Embodiment

Figure 1:
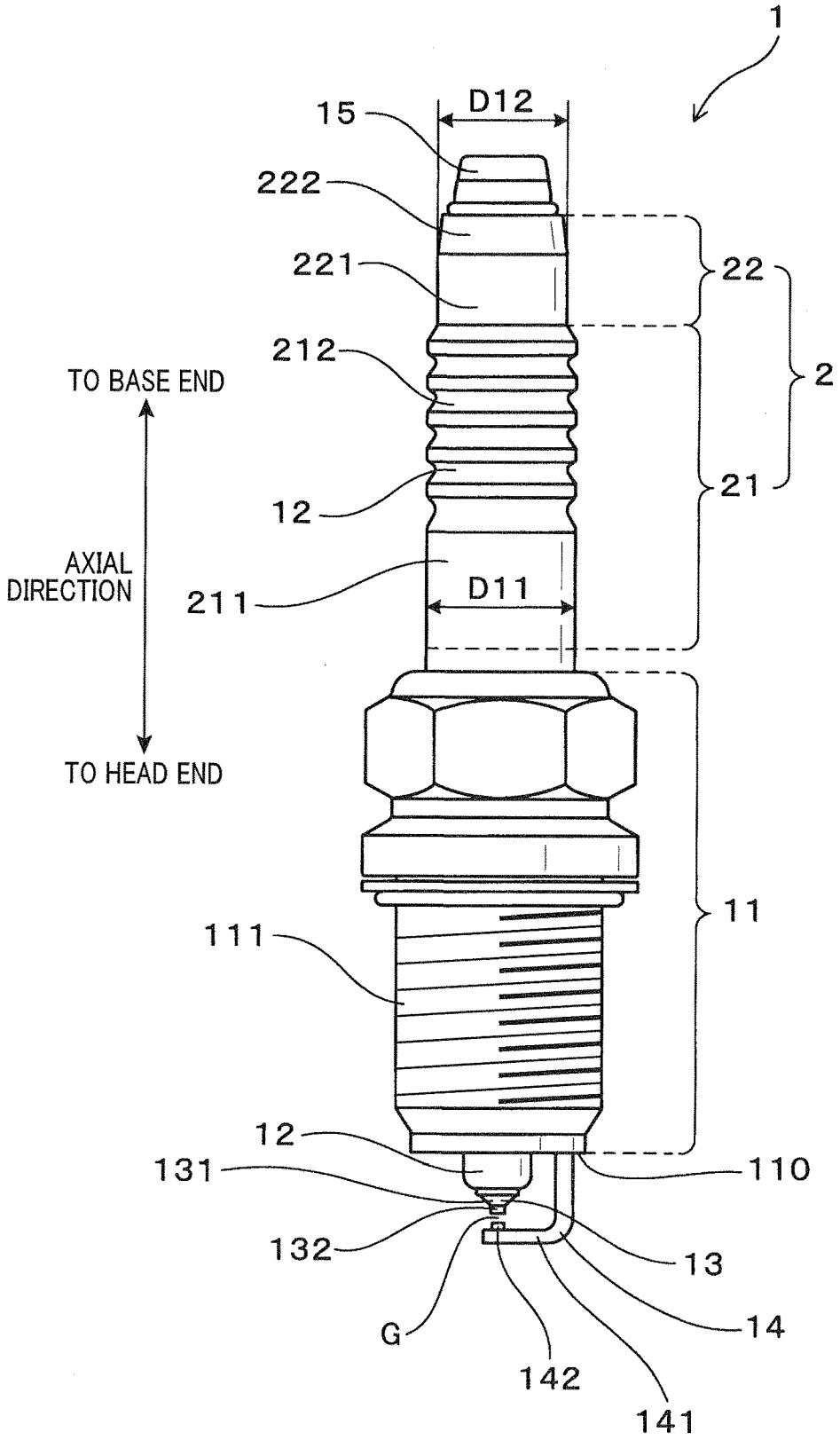
FIG. 1 is a side view illustrating the spark plug according to the first embodiment.
Figure 2:
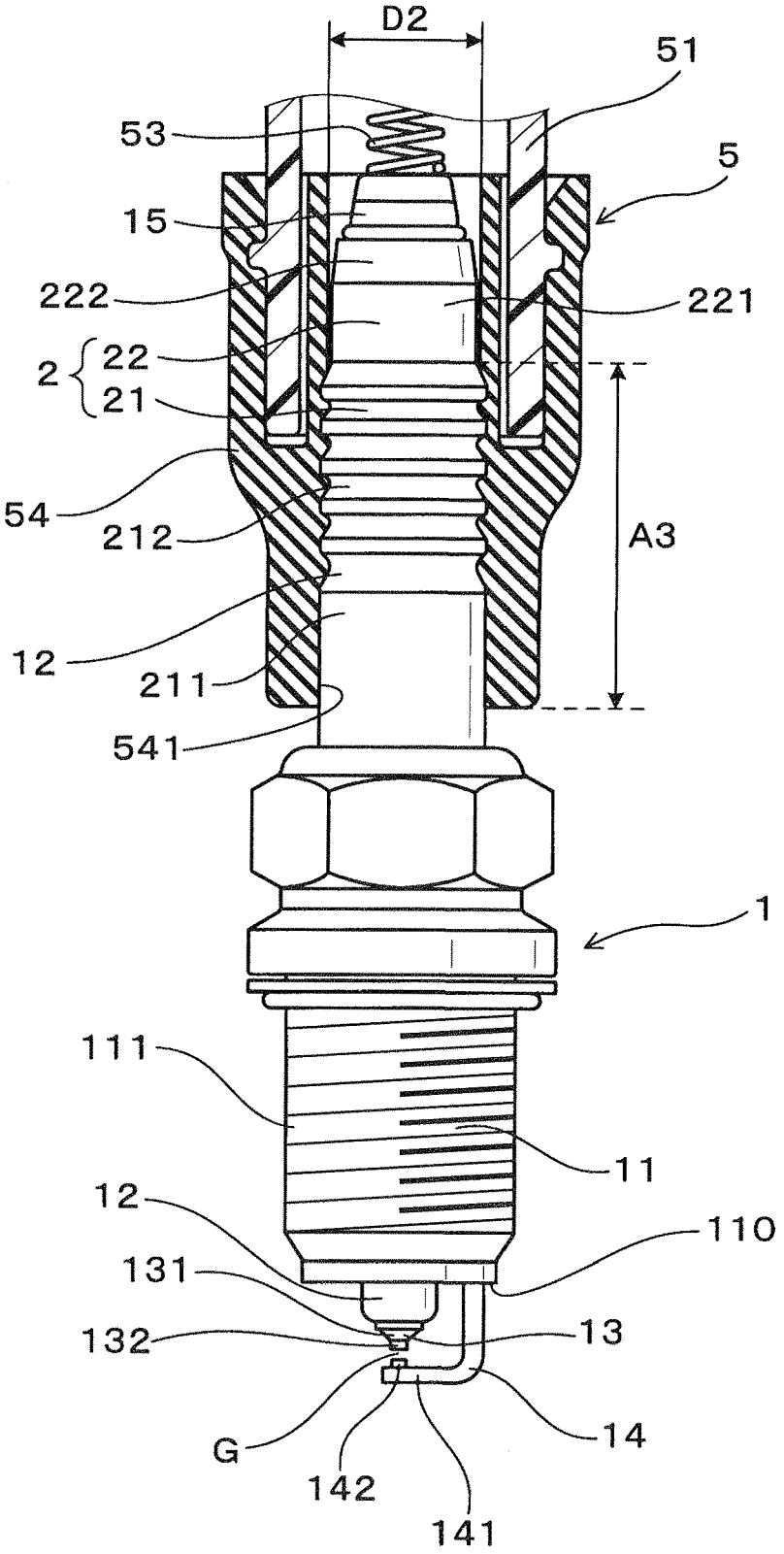
FIG. 2 is a partial cross-sectional view illustrating the spark plug and the plug cap according to the first embodiment.
Figure 3:
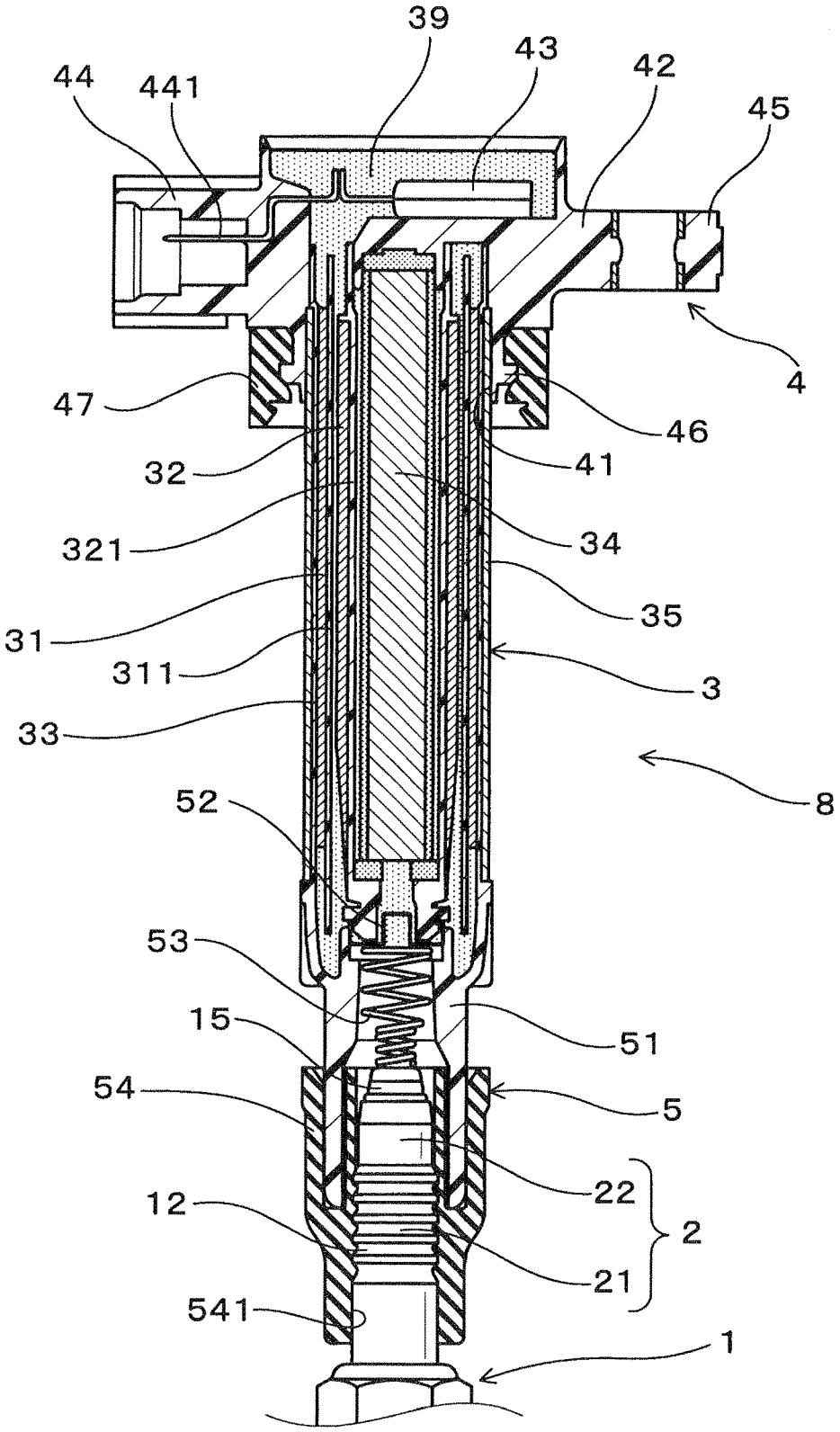
FIG. 3 is a cross-sectional view illustrating the ignition system according to the first embodiment.

A first embodiment of a spark plug and an ignition system having the spark plug is described, referring to FIG. 1 to FIG. 3. The spark plug 1 and the ignition system 8 according to the first embodiment is used for vehicles having an engine.

The spark plug according to this embodiment, as shown in FIG. 1 and FIG. 2, has a housing 11, an insulator 12, a center electrode 13, a ground electrode 14, and, a terminal portion 15.

The housing 11 has a cylindrical shape such as to surrounds the axis of the spark plug 1 and to extend along the axis of the spark plug 1. Here, throughout the specification and claims, "cylindrical" means a shape such as to surround an axis and extend along the axis, the cylindrical object is not necessarily circular in a cross-section perpendicular to the axis, not necessarily rotationally symmetric, does not necessarily have constant shape along the axis, and may have a gap partly in the circumferential direction.

The insulator 12 is cylindrical, held inside of the housing 11, and projected further toward the base end side than the housing 11. The center electrode 13 is held inside of the insulator 12, and is projected further toward the head end side than the insulator 12. A spark discharge gap G is formed between the center electrode 13 and the ground electrode 14. The terminal portion 15 is held inside of the insulator 12, and is projected further toward the base end side than the insulator 12. There is electrical continuity between the terminal portion 15 and the center electrode 13.

As shown in FIG. 1 and FIG. 2, the insulator 12 has an insertion portion 2. The insertion portion 2 is arranged to be closer to the base end side than the housing 11, and is inserted inside of a cylindrical plug cap 54 of the ignition system 8. The insertion portion 2 has a non-fit portion 22 provided at the base end of the insulator 12 and a fit portion 21 arranged to the head end side of the non-fit portion 22. The fit portion 21 fits in an inner surface 541 of the plug cap 54. The non-fit portion 22 has an outer diameter which is equal to or smaller than an inner diameter of the plug cap 54.

The ignition system 8 according to this embodiment, as shown in FIG. 3, has the spark plug 1, a coil portion 3 and a plug joint portion 5. The coil portion 3 functions as an ignition coil, and has a primary coil 31 and a secondary coil 32. The plug joint portion 5 is provided for electrically connecting a high-voltage side end of the secondary coil 32 of the coil portion 3 to the terminal portion 15 of the spark plug 1.

The plug joint portion 5 has the cylindrical plug cap 54 into which the insertion portion 2 of the insulator 12 of the spark plug 1 is inserted.

Hereinafter this is described in detail.

At first, the spark plug 1 is explained.

As shown in FIG. 1, the spark plug 1 according to this embodiment is provided with an attachment screw portion 111 on an outer periphery of the housing 11. The spark plug 1 is fastened to a combustion chamber of the engine by using the attachment screw portion 111 of the housing 11 through a screw hole (not shown in the drawings) formed in a wall portion of the combustion chamber of the engine.

The insulator 12 is inserted and held inside of the housing 11. The insulator 12 is projected further toward the head end side and the base end side than the housing 11.

As shown in FIG. 1, the center electrode 13 is held inside of the insulator 12. The center electrode 13 is projected further toward the head end than the insulator 12 is. At a head end 131 of the center electrode 13 is provided an end projection portion 132. The end projection portion 132 is projected toward a facing portion 141 of the ground electrode 14 (described below).

The terminal portion 15 electrically connected to the center electrode 13 is held inside of the insulator 12. The terminal portion 15 is projected further toward the base end side than the insulator 12 is.

As shown in FIG. 1, the ground electrode 14 is joined to a head end face 110 of the housing 11. The ground electrode 14 extends from the head end face 110 of the housing 11 along the center electrode 13, and bends radially inward to form the facing portion 141 facing the head end 131 of the center electrode 13. The facing portion 141 is provided with a facing projection portion 142 projected toward the head end 131 of the center electrode 13. The spark discharge gap G is formed between the facing projection portion 142 and the end projection portion 132 of the head end 131 of the center electrode 13.

As shown in FIG. 1 and FIG. 2, the insulator 12 has the insertion portion 2 at a portion which is projected further toward the base end side than the housing 11. The insertion portion 2 is inserted into the cylindrical plug cap 54.

The insertion portion 2 has the non-fit portion 22 which is not fitted in the plug cap 54, and, the fit portion 21 which contacts the inner surface 541 of the plug cap 54 to be fitted in the plug cap 54.

As shown in FIG. 1 and FIG. 2, the non-fit portion 22 is formed at a portion which ranges from the base end of the insulator 12 a predetermined distance further toward the head end side. The non-fit portion 22 has a first portion 221 and a second portion 222 the outer diameter of which is equal to or smaller than that of the first portion 221. The outer diameter of the first portion 221 in the non-fit portion 22 is substantially constant in the axial direction. The second portion 222 of the non-fit portion 22 is arranged closer to the base end side than the first portion 221 is, and the outer diameter of the second portion 222 is reduced toward the base end side. The outer diameter of the non-fit portion 22 (the first portion 221 and the second portion 222) is equal to or smaller than the inner diameter D2 of the plug cap 54, and preferably, smaller than the inner diameter D2 of the plug cap 54.

As shown in FIG. 1 and FIG. 2, the fit portion 21 is formed to the head end side of the non-fit portion 22. A corrugation portion 212 having concavities and convexities on its surface is formed at a part of the fit portion 21. The concavities and convexities are annular and formed alternatively along the axial direction. A smooth portion 211 with a substantially constant outer diameter in the axial direction is formed to the head end side of the corrugation portion 212. The fit portion 21 is pressed to be inserted in the plug cap 54.

Next, the ignition system 8 is described.

As shown in FIG. 3, the ignition system 8 has the coil portion 3 and a connector case portion 4. The coil portion 3 has a coil case 33, the primary coil 31 and the secondary coil 32. The primary coil 31 and the secondary coil 32 are concentrically disposed in the coil case 33. The connector case portion 4 is provided with a fit hole 41 in which a base end of the coil portion 3 is fit. The connector case portion 4 has a connector portion 42 for energizing the primary coil 31 and interrupting power to the primary coil 31.

The coil portion 3 is disposed in a plug hole of an engine. A head end of the coil portion 3 is provided with the plug joint portion 5 for attaching the spark plug 1.

The connector case portion 4 is disposed outside the plug hole of the engine. The connector case portion 4 is fitted in the base end of the coil portion 3.

As shown in FIG. 3, in the coil portion 3, a center core 34 made from soft magnetic material is disposed inside of the primary coil 31 and the secondary coil 32. An outer core 35 made from soft magnetic material is disposed outside of the coil case 33.

The primary coil 31 is formed by winding a primary electric wire around an outer periphery of a plastic primary spool 311. The secondary coil 32 is formed by winding a secondary electric wire around an outer periphery of a plastic secondary spool 321 more times than the primary coil 31 is formed. The secondary electric wire is thinner than the primary electric wire.

As shown in FIG. 3, the fit hole 41 of the connector case portion 4 is formed to penetrate the connector case portion 4. The base end of the coil portion 3 is inserted from the head end side of the fit hole 41 of the connector case portion 4 to be fitted in the fit hole 41. When the coil portion 3 is fitted in the connector case portion 4, the axes of the center core 34, the primary coil 31 and the secondary coil 32 are aligned.

Gaps formed in the coil portion 3 and the connector case portion 4 are filled with epoxy resin 39 as thermoset resin.

An igniter 43 is disposed in the connector case portion 4. The igniter 43 has a built-in switching circuit that energizes the primary coil 31 and interrupts electric power to the primary coil 31.

The connector case portion 4 has a connector terminal portion 44 in which a plurality of conductor pins 441 are arranged side-by-side, and, an attachment portion 45 for fixing the ignition system 8 to the engine. The connector terminal portion 44 and the attachment portion 45 are projected in the radial direction outward of the connector case portion 4.

In the connector terminal portion 44, a plurality of conductor pins 441 such as a positive side power supply pin, a negative side power supply pin and a switching signal pin are arranged side-by-side.

A cylindrical projection portion 46 formed at the head end of the connector case portion 4 is fitted in a rubber seal 47 for preventing water from entering into the plug hole.

As shown in FIG. 3, the plug joint portion 5 has a plastic cylindrical base portion 51, a high-voltage terminal 52, a coil spring 53, and, the plug cap 54. The cylindrical base portion 51 is connected to the coil case 33 (in this embodiment, formed to the head end of the coil case 33 with the coil case 33 into a unit). The high-voltage terminal 52 is electrically connected to the high-voltage side end of the secondary coil 32 in the head end of the primary spool 311. The coil spring 53 electrically connects the high-voltage terminal 52 and the terminal portion 15 of the spark plug 1. The plug cap 54 in which the insertion portion 2 of the insulator 12 of the spark plug 1 is inserted and fit is made from rubber.

As shown in FIG. 2 and FIG. 3, in the spark plug 1, the non-fit portion 22 of the insertion portion 2, which is inserted into the plug cap 54, forms gaps between itself and the inner surface 541 of the plug cap 54. Therefore, the non-fit portion 2 is not fitted in the plug cap 54, and does not generate force to fix itself to the plug cap 54 against load in the axial direction. On the other hand, the fit portion 21 of the insertion portion 2 contacts the inner surface 541 of the plug cap 54 in a state where the insertion portion 2 is pressed to be inserted in the plug cap 54, fits in the plug cap 54, and generates force to fix the insertion portion 2 to the plug cap 54.

Next, function effects of the spark plug 1 and the ignition system 8 having the spark plug 1 according to this embodiment are described.

In the spark plug 1 according to this embodiment, the insulator 12 has the insertion portion 2 to be inserted into the cylindrical plug cap 54. The insertion portion 2 has the non-fit portion 22 formed at the base end of the insulator 12, the non-fit portion 22 having the outer diameter which is equal to or smaller than the inner diameter D2 of the plug cap 54. Furthermore, the insertion portion 2 has the fit portion 21 which is formed to the head end side of the non-fit portion 22 and fitted in the inner surface 541 of the plug cap 54. This configuration allows workability for attaching the spark plug 1 to the plug cap 54 to be maintained, and can increase the electrical insulation performance through the plug cap 54.

For example, the insulator 12 is extended toward the base end side, depending on the demanded voltage of the spark plug 1. In this case, the extended part is formed to be the non-fit portion 22. This allows the insulator 12 to be extended toward the base end without changing the axial length A3 (shown in FIG. 2) of the portion where the insulator 12 and the plug cap 54 fit together (i.e. the fit portion 21). By this, the increase of the insertion and separation force in the plug cap 54 can be prevented, and workability for attaching the spark plug 1 to the plug cap 54 can be maintained.

On the other hand, the electrical insulation distance between the terminal portion 15 and the housing 11 in the spark plug 1 is extended by the length of the portion (the non-fit portion 22) extended toward the base end side in the insulator 12. This can increase the electrical insulation performance in the plug cap 54.

Therefore, the electrical insulation performance in the plug cap 54 can be increased, while workability for attaching the spark plug 1 to the plug cap 54 can be maintained.

Furthermore, the ignition system 8 according to this embodiment has the coil portion 3 and the plug joint portion 5 besides the above-described spark plug 1. The plug joint portion 5 has the cylindrical plug cap 54 inside of which the insertion portion 2 of the insulator 12 of the spark plug 1 is inserted. The non-fit portion 22 of the insertion portion 2 of the insulator 12, which is inserted in the plug cap 54, is not fitted in the plug cap 54. On the other hand, the fit portion 21 of the insertion portion 2 is fitted in the inner surface 541 of the plug cap 54.

This can increase the electrical insulation performance in the plug cap 54, while workability for attaching the spark plug 1 to the plug cap 54 can be maintained.

Furthermore, at least a part of the fit portion 21 in the insertion portion 2 of the insulator 12 is provided with the corrugation portion 212 having concavities and convexities on its surface. Therefore, the corrugation portion 212 having concavities and convexities on its surface can make the electrical insulation distance between the terminal portion 15 and the housing 11 longer. This can increase the electrical insulation performance in the plug cap 54 more.

Thus, applying this embodiment can supply the spark plug 1 for an internal combustion engine and the ignition system 8 having the spark plug 1, which can increase the electrical insulation performance in the plug cap 54, and can maintain workability for attaching it to the plug cap 54.

Second Embodiment

Figure 4:
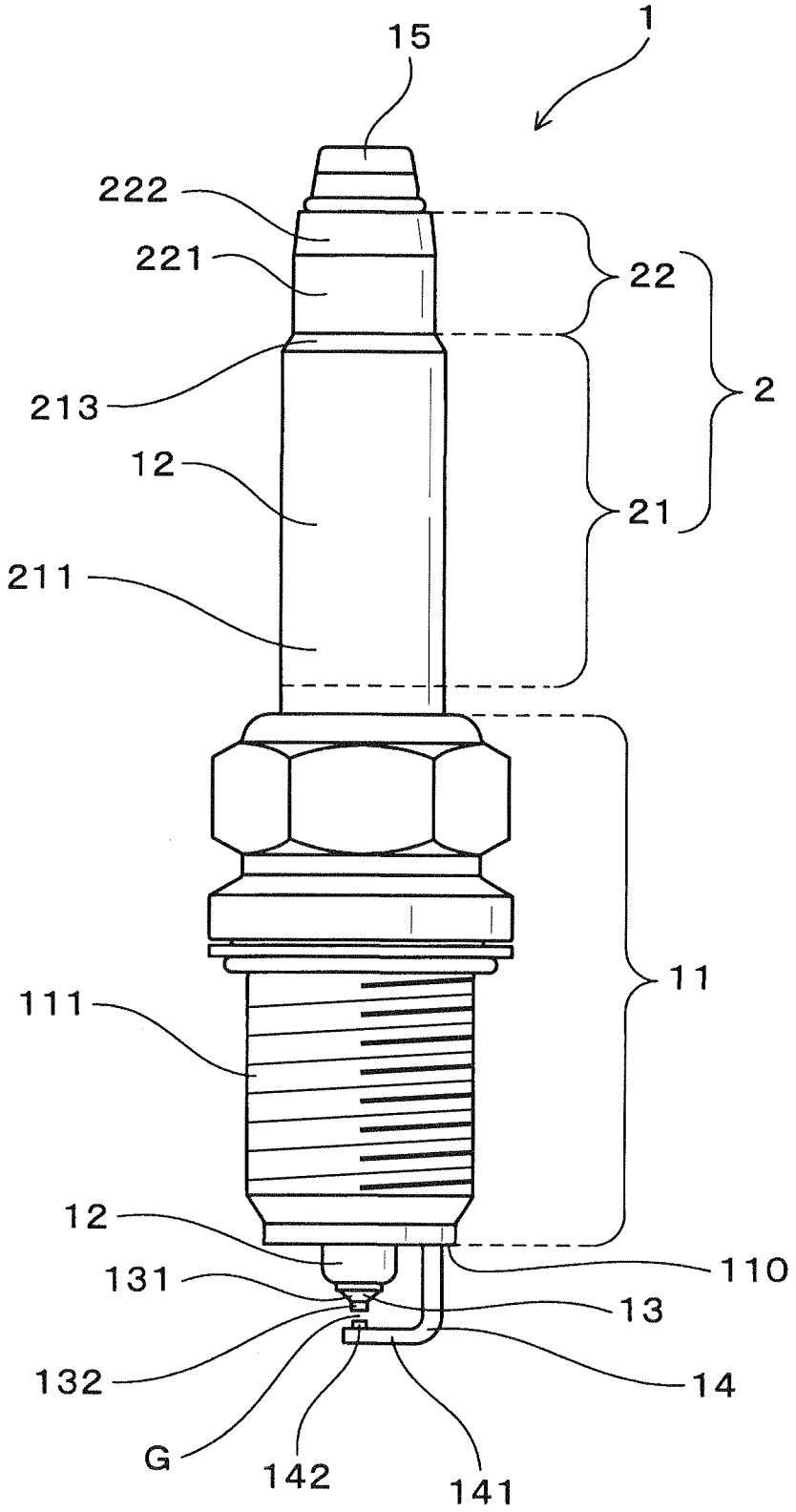
FIG. 4 is a side view illustrating the spark plug according to the second embodiment.

A second embodiment is described, referring to FIG. 4.

This embodiment, as shown in FIG. 4, is an example where the shape of the insulator 12 of the spark plug 1 is modified.

As shown in FIG. 4, in the insulator 12 of the spark plug 1, the fit portion 21 of the insertion portion 2 has a smooth portion 211 and a fit diameter reduction portion 213. The smooth portion 211 has a substantially constant outer diameter in the axial direction. The outer diameter of the fit diameter reduction portion 213 is reduced toward the base end side.

That is to say, unlike the first embodiment, the fit portion 21 does not have the corrugation portion 212 (shown in FIG. 1 and FIG. 2). Other basic configurations and function effects are the same as the first embodiment.

[Test for Evaluating Performance]

A test was performed for evaluating performance of the spark plug according to the first embodiment.

In this test, a plurality of spark plugs (specimen 1 to specimen 3) deferring from each other in configurations of insulators are prepared. Then, each spark plug is evaluated for the electrical insulation performance in a plug cap (also described below as "electrical sealing performance") and attachment workability to a plug cap.

Next, configurations of the prepared spark plugs (specimen 1 to specimen 3) are described.

Figure 5:
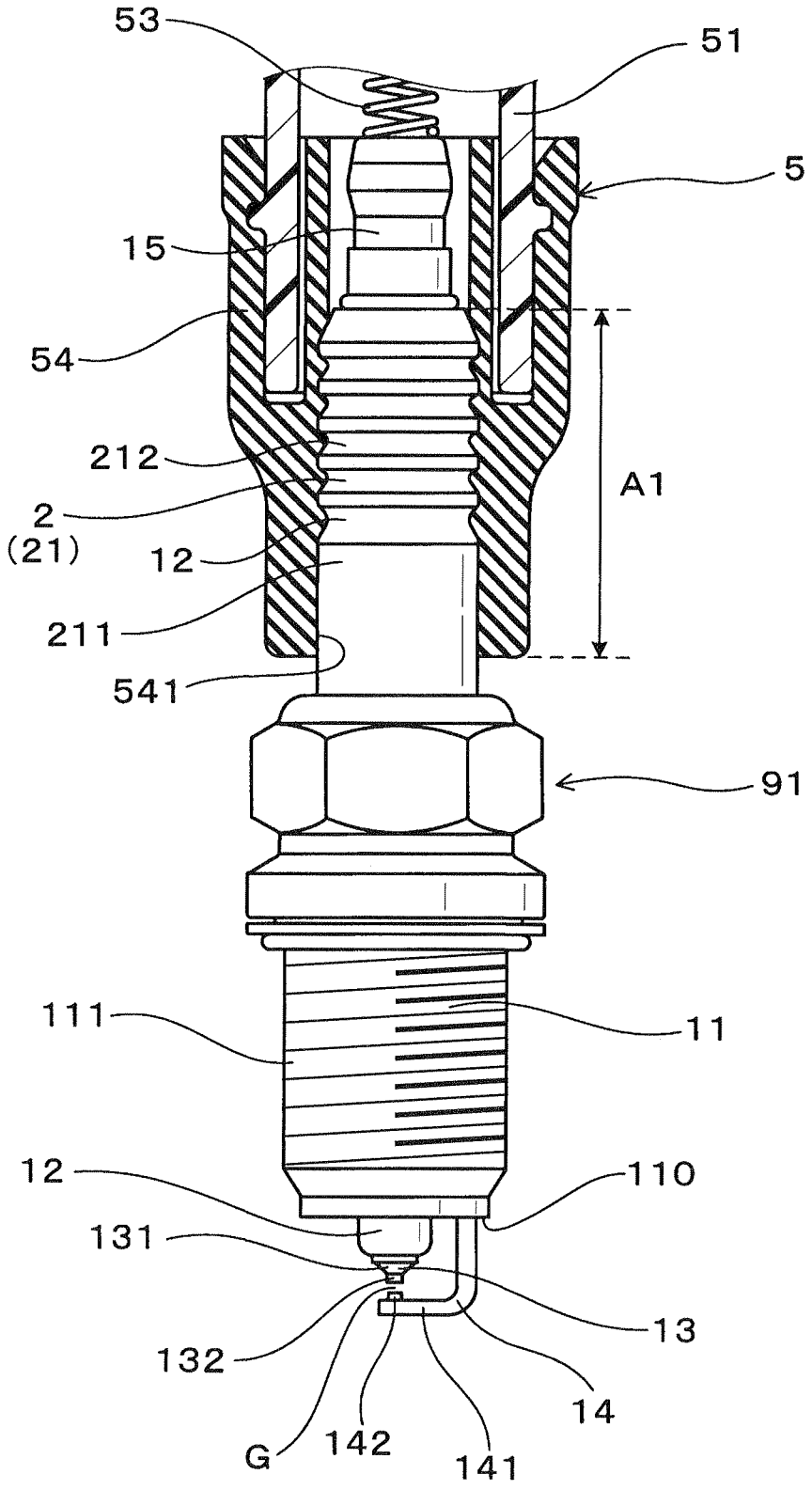
FIG. 5 is a partial cross-sectional view illustrating the spark plug according to the specimen 1 in the evaluating test.

A spark plug of the specimen 1 is, as shown in FIG. 5, a spark plug 91 in which whole of an insertion portion 2 of an insulator 12 is the portion fitted in the plug cap 54 (the fit portion 21). Other basic configurations of the spark plug 91 are the same as the spark plug 1 according to the first embodiment (shown in FIG. 1 and FIG. 2).

Figure 6:
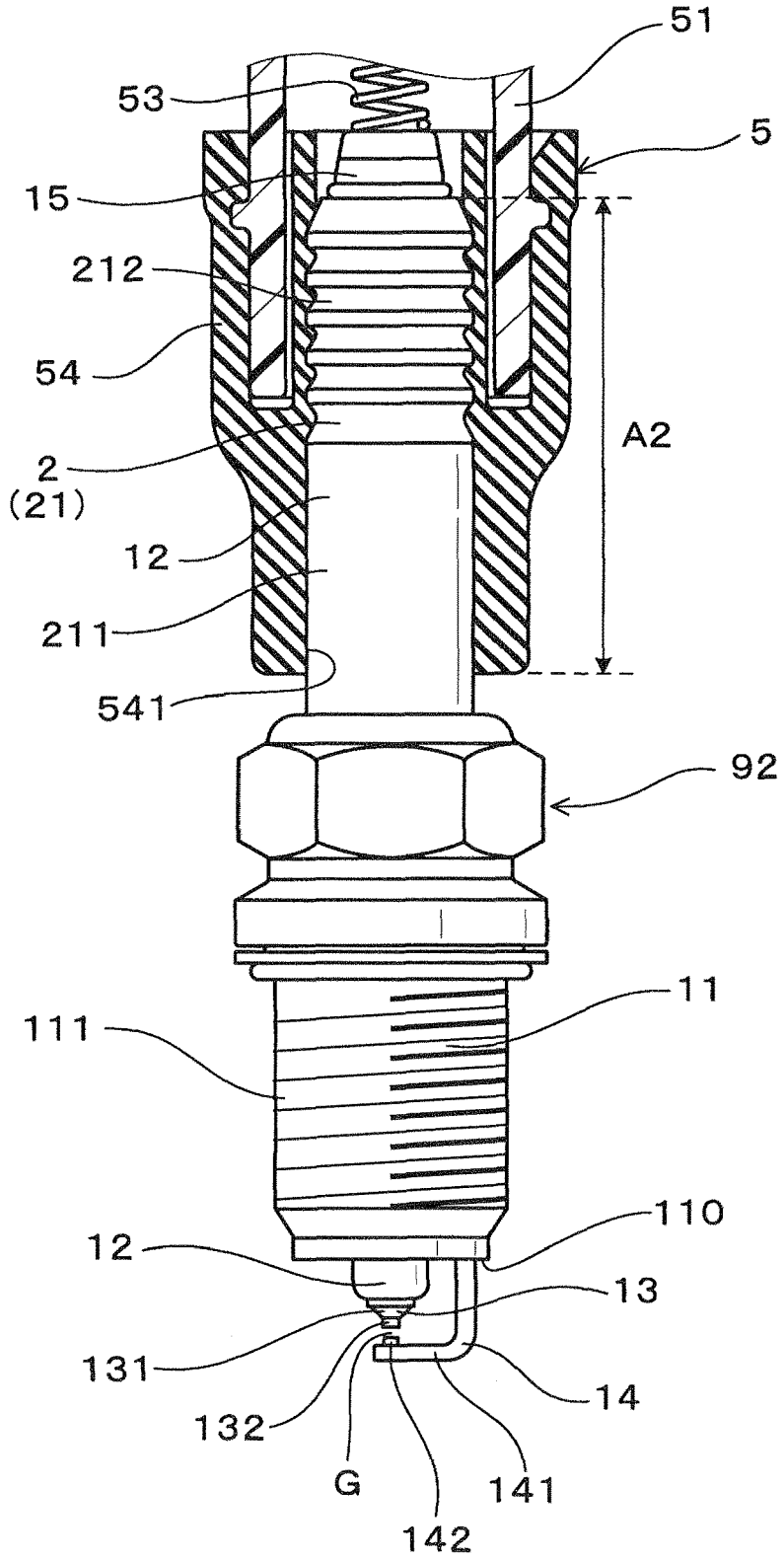
FIG. 6 is a partial cross-sectional view illustrating the spark plug according to the specimen 2 in the evaluating test.

A spark plug of the specimen 2 is, as shown in FIG. 6, a spark plug 92 in which an insulator 12 is extended toward the base end side further than the base end of the insulator 12 according to the specimen 1 is. Therefore, the electrical insulation distance between a terminal portion 15 and a housing 11 is longer than that of the specimen 1. However, as same as the specimen 1, the whole of an insertion portion 2 of an insulator 12 is the portion fitted in the plug cap 54 (a fit portion 21). Therefore, the axial length A2 of the portion fitted in the plug cap 54 (the fit portion 21) is longer than the axial length A1 (shown in FIG. 5) of the specimen 1. Other basic configurations of the spark plug 92 are the same as the spark plug 1 according to the first embodiment (shown in FIG. 1 and FIG. 2).

A spark plug of the specimen 3 is, as shown in FIG. 1 and FIG. 2, a spark plug 1 according to the first embodiment. Specifically, as same as the specimen 2, the insulator 12 of the specimen 1 is extended toward the base end side further than the base end of the insulator 12 according to the specimen 1. Therefore, the electrical insulation distance between the terminal portion 15 and the housing 11 is longer than that of the specimen 1. On the other hand, a part of the insertion portion 2 of the insulator 12 is provided with the non-fit portion 22. Therefore, an axial length A3 (shown in FIG. 2) of a portion fitted in the plug cap 54 (the fit portion 21) is the same as the axial length A1 (shown in FIG. 5) of the specimen 1.

In the spark plug 1 of the specimen 3, the outer diameter D11 (shown in FIG. 1) of the smooth portion 211 of the fit portion 21 in the insertion portion 2 of the insulator 12 is 10.5 mm, the maximum inner diameter D12 (shown in FIG. 1) of the non-fit portion 22 is 9.5 mm, and, the inner diameter D2 (shown in FIG. 2) of the plug cap 54 is 9.5 mm. In each of the spark plugs 91, 92 of the specimens 1 and 2, the outer diameter D11 of the smooth portion 211 of the fit portion 21 and the inner diameter D2 of the plug cap 54 are the same as the ones of the spark plug 1 of the specimen 3.

Next, evaluation method of the electrical sealing performance is described.

For the evaluation of the electrical sealing performance, at first, the plug cap is attached to the spark plug, and the spark plug is connected to the coil portion. Then, primary voltage is applied to the coil portion by a constant-voltage power supply device. After that, increasing the primary voltage supplied from the constant-voltage power supply device increases the secondary voltage generated in the coil portion. Then, the secondary voltage at the time when the electrical leak between the terminal portion and the housing occurs is measured. The measured secondary voltage is obtained as electrical leak voltage. In measurement of the secondary voltage, a high-voltage probe is inserted between the coil portion and the spark plug, FIG. 7 shows the evaluation result of the electric insulation performance.

Figure 7:
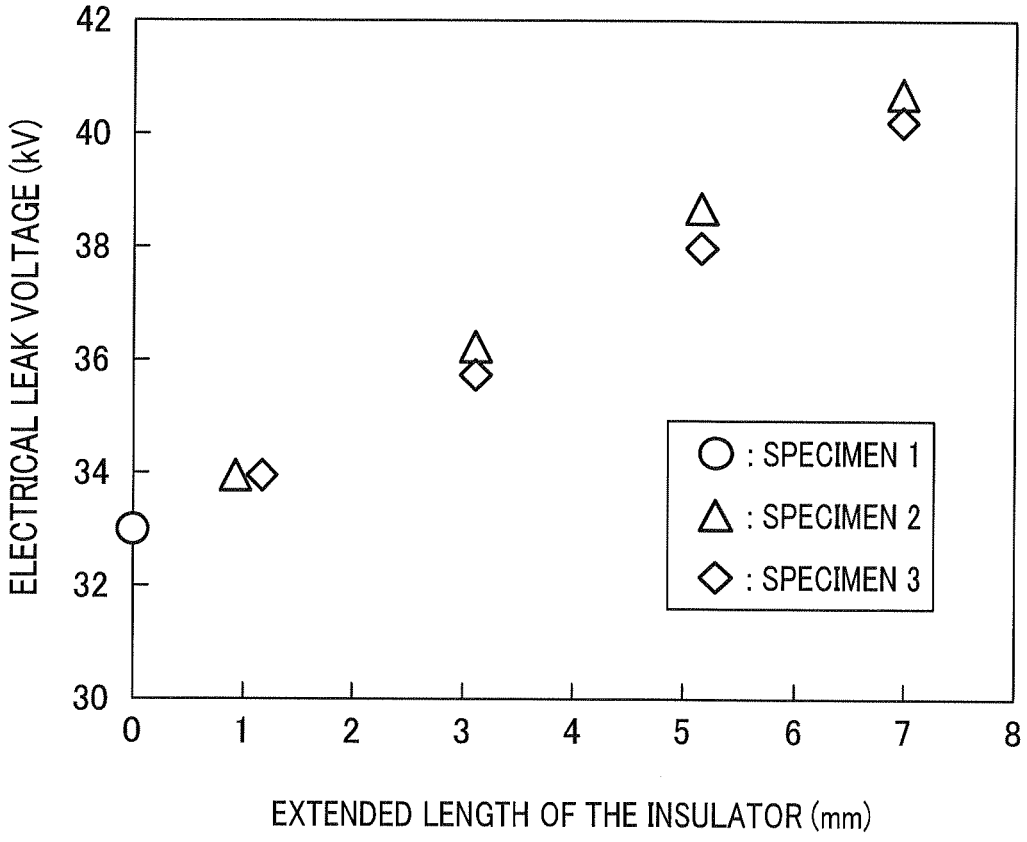
FIG. 7 is a chart showing the relation between extended length of the insulator and electrical leak voltage of each specimen.

In FIG. 7, the abscissa shows the extended length (mm) of the insulator, and the ordinate shows the electrical leak voltage (kV). The extended length of the insulator is a length by which the insulator is extended from the base end of the insulator of the specimen 1, as a basis (0 mm), further toward the base end side than the specimen 1, i.e. the difference between its base end and the base end of the insulator of the specimen 1.

According to FIG. 7, it was confirmed that the electrical leak voltage of the specimens 2, 3 was higher than that of the specimen 1. The reason is that extending the insulators of the specimens 2, 3 further toward the base end side than the specimen 1 lengthens the electrical insulation distance between the insulator and the housing in each of the specimens 2, 3. Furthermore, it was confirmed that the electrical leak voltage increased as the extended length of the insulator increased.

Next, evaluation method of attachment workability is described.

For the evaluation of the attachment workability, at first, an Autograph (manufactured by SHIMADZU Corporation) was connected to the plug cap. Then, the spark plug was inserted into the plug cap. The load needed at the insertion was measured by the Autograph, and this measured load was obtained as an insertion force. Furthermore, the spark plug was separated from the plug cap connected to the Autograph. The load needed at the separation was measured by the Autograph, and this measured load was obtained as a separation force.

Figure 8:
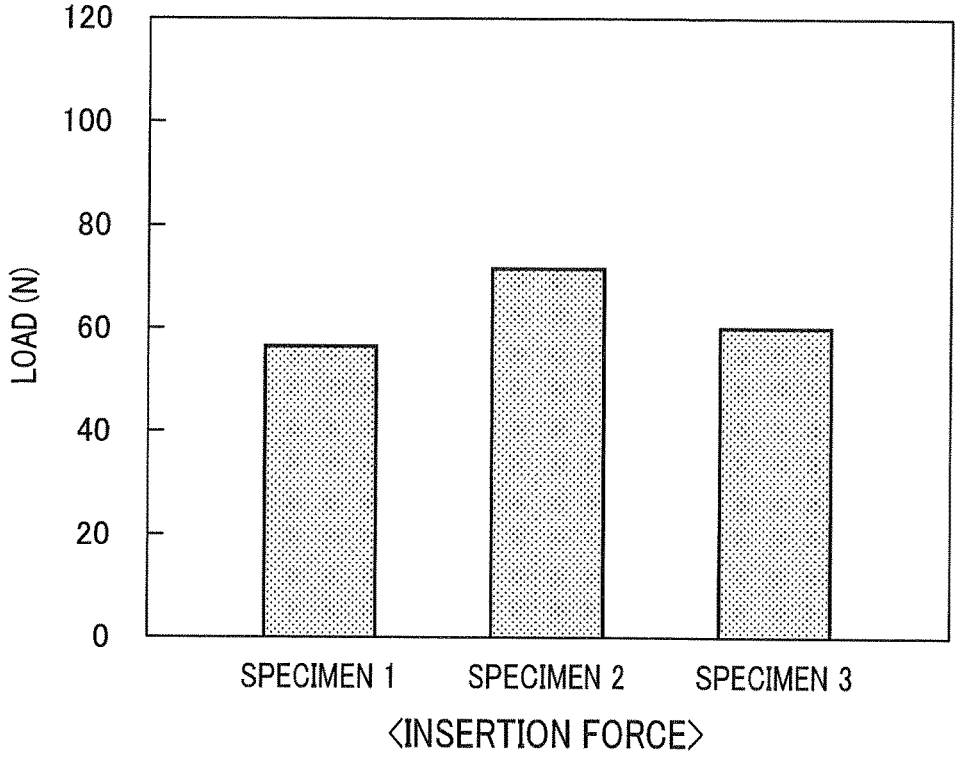
FIG. 8 is a bar chart showing the insertion force into the plug cap for each specimen.
Figure 9:
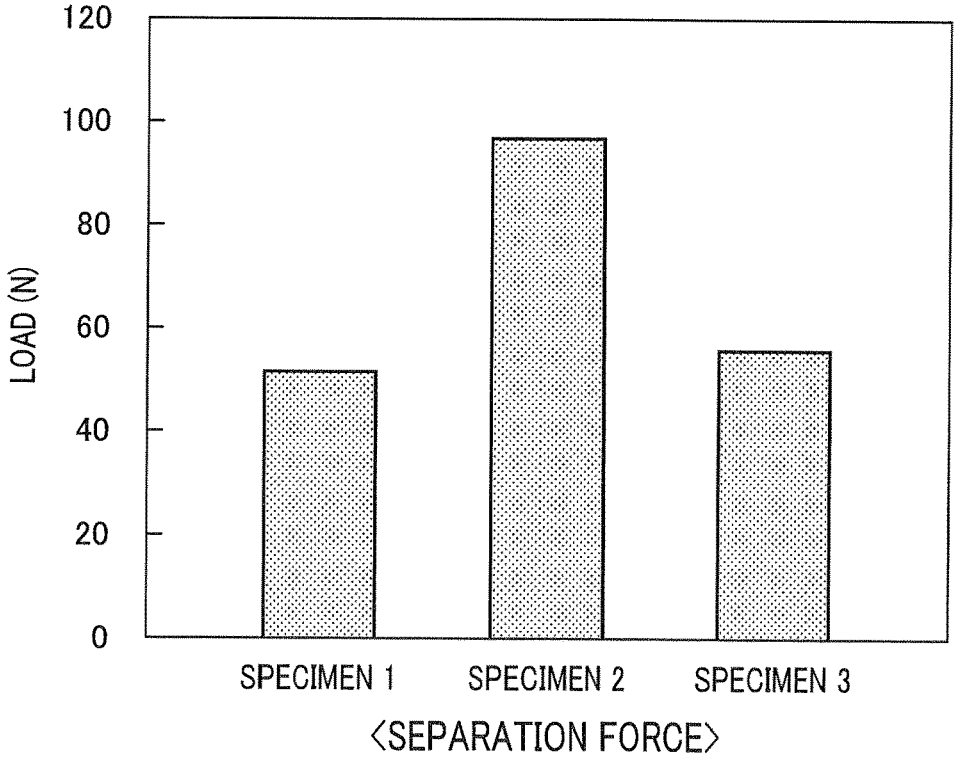
FIG. 9 is a bar chart showing the separation force from the plug cap for each specimen.

FIG. 8 and FIG. 9 show the evaluation result of attachment workability (insertion force and separation force).

FIG. 8 shows the evaluation result of insertion force into the plug cap, FIG. 9 shows the evaluation result of separation force from the plug cap. In FIG. 8 and FIG. 9, the ordinates show the load (N) needed for the insertion or separation in the spark plug.

According to FIG. 8 and FIG. 9, it was confirmed that the insertion and separation force for the specimen 2 was higher than that of the specimen 1. The reason is that extending the insulator of the specimen 2 toward further the base end side than the specimen 1 lengthens the axial length of the portion where the insulator and the plug cap fit together (i.e. the fit portion).

On the other hand, it was confirmed that the insertion and separation force for the specimen 2 were substantially the same as that of the specimen 1. The reason for this is that the axial length of the portion where the insulator and the plug cap fit together (i.e. the fit portion) is not changed, though the insulator of the specimen 3 is extended toward further the base end side than the specimen 1.

It was confirmed that making the spark plug of the first embodiment (specimen 3) to have the insertion portion of the insulator provided with the non-fit portion can maintain attachment workability to the plug cap, and can increase the electrical insulation performance in the plug cap.

What is claimed is:

1. A spark plug for an internal combustion engine, extending in an axial direction, having a base end and a head end in the axial direction, and comprising:

a cylindrical housing;

a cylindrical insulator held inside of the housing, and projected further toward a base end side than the housing is, the insulator including an insertion portion arranged closer to the base end side than the housing is, the insertion portion being to be inserted into a cylindrical plug cap, the cylindrical plug cap being made of an elastic material and having a fixed inner diameter in a state before the insulator is inserted into the plug cap;

a center electrode held inside of the insulator, and projected further toward a head end side than the insulator is;

a ground electrode forming a spark discharge gap between the center electrode and the ground electrode; and a terminal element held inside of the insulator, projected further toward the base end side than the insulator is, and electrically connected to the center electrode;

wherein the insertion portion of the insulator comprises:

a non-fit portion formed at the base end of the insulator, an outer diameter of the non-fit portion being equal to or less than an inner diameter of the plug cap in a state before the insertion portion is inserted into the plug cap, the non-fit portion having a first portion and a second portion, the outer diameter of the first portion being substantially constant in the axial direction, the second portion being arranged closer to the base end side than the first portion, the outer diameter of the second portion being gradually reduced toward the base end side, the non-fit portion having an axial length depending on a demanded voltage of the spark plug; and a fit portion formed at the head end side of the non-fit portion and adjacent to the non-fit portion in the axial direction, the fit portion being to be pressed to be inserted in the plug cap, the outer diameter of the fit portion being greater than that of the non-fit portion and greater than the inner diameter of the plug cap in a state before the insertion portion is inserted into the plug cap, the fit portion having a fixed axial length not depending on the demanded voltage of the spark plug.

2. The spark plug according to claim 1, wherein, at least a part of the fit portion of the insertion portion of the insulator is provided with a corrugation portion having concavity and a convexity on its surface.

3. An ignition system for an internal combustion engine, comprising:

a spark plug extending in an axial direction, having a base end and a head end in the axial direction, the spark plug comprising:

a cylindrical housing;

a cylindrical insulator held inside of the housing, and projected further toward a base end side than the housing is, the insulator including an insertion portion arranged closer to the base end side than the housing is, the insertion portion being inserted into a cylindrical plug cap, the cylindrical plug cap being made of an elastic material and having a fixed inner diameter in a state before the insulator is inserted into the plug cap;

a center electrode held inside of the insulator, and projected further toward a head end side than the insulator is;

a ground electrode forming a spark discharge gap between the center electrode and the ground electrode; and a terminal element held inside of the insulator, projected further toward the base end side than the insulator is, and electrically connected to the center electrode;

wherein the insertion portion of the insulator comprises:

a non-fit portion formed at the base end of the insulator, an outer diameter of the non-fit portion being equal to or less than the inner diameter of the plug cap in a state before the insertion portion is inserted into the plug cap, the non-fit portion having a first portion and a second portion, the outer diameter of the first portion being substantially constant in the axial direction, the second portion being arranged closer to the base end side than the first portion, the outer diameter of the second portion being gradually reduced toward the base end side, the non-fit portion having an axial length depending on a demanded voltage of the spark plug; and a fit portion formed at the head end side of the non-fit portion and adjacent to the non-fit portion in the axial direction, the fit portion being to be pressed to be inserted in the plug cap, the outer diameter of the fit portion being greater than that of the non-fit portion and greater than the inner diameter of the plug cap in a state before the insertion portion is inserted into the plug cap, the fit portion having a fixed axial length not depending on the demanded voltage of the spark plug;

a coil portion having a primary coil and a secondary coil, the secondary coil having a high-voltage side end; and a plug joint portion configured to electrically connect the high-voltage side end of the secondary coil of the coil portion to the terminal element of the spark plug, wherein, the plug joint portion includes the plug cap inside of which the insertion portion of the insulator of the spark plug is inserted.

4. The ignition system according to claim 3, wherein, at least a part of the fit portion of the insertion portion of the insulator is provided with a corrugation portion having concavity and a convexity on its surface.

5. The spark plug according to claim 1, wherein a degree of change in outer diameter of the first portion is less than a degree of change of the outer diameter of the second portion.

6. The ignition system according to claim 3, wherein a degree of diameter change in outer diameter of the first portion is less than a degree of change of the outer diameter of the second portion.

7. The ignition system according to claim 3, wherein the plug cap has an inner portion and an outer portion, the inner portion being located inside the outer portion, the inner portion having a fit portion and a non-fit portion which are adjacent to each other in the axial direction, the fit portion of the plug cap press fitting the fit portion of the insulator, the non-fit portion of the insulator being inserted into the non-fit portion of the plug cap.

8. The spark plug according to claim 1, wherein the demanded voltage of the spark plug is a voltage which is applied between the center electrode and the ground electrode, and needed for discharges to occur.

9. The spark plug according to claim 3, wherein the demanded voltage of the spark plug is a voltage which is applied between the center electrode and the ground electrode, and needed for discharges to occur.

* * * * *